US010487673B2

(12) United States Patent
Zelmer

(10) Patent No.: US 10,487,673 B2
(45) Date of Patent: Nov. 26, 2019

(54) ROTOR BLADE ARRANGEMENT HAVING ELASTIC SUPPORT ELEMENTS FOR A THERMAL TURBOMACHINE

(71) Applicant: Siemens Aktiengesellschaft, Munich (DE)

(72) Inventor: Dimitri Zelmer, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 65 days.

(21) Appl. No.: 15/741,907

(22) PCT Filed: Jun. 30, 2016

(86) PCT No.: PCT/EP2016/065271
§ 371 (c)(1),
(2) Date: Jan. 4, 2018

(87) PCT Pub. No.: WO2017/005592
PCT Pub. Date: Jan. 12, 2017

(65) Prior Publication Data

US 2018/0195399 A1 Jul. 12, 2018

(30) Foreign Application Priority Data

Jul. 9, 2015 (EP) ..... 15176056

(51) Int. Cl.
*F01D 5/30* (2006.01)
*F01D 5/26* (2006.01)
(Continued)

(52) U.S. Cl.
CPC ..... *F01D 5/3038* (2013.01); *F01D 5/26* (2013.01); *F01D 5/32* (2013.01); *F04D 29/322* (2013.01);
(Continued)

(58) Field of Classification Search
CPC ..... F01D 5/3023; F01D 5/303; F01D 5/3038; F01D 5/3046; F01D 5/26; F04D 29/322; F05D 2260/38; F05D 2260/96
(Continued)

(56) References Cited

U.S. PATENT DOCUMENTS 2,643,853 A 6/1953 Redding
3,252,687 A * 5/1966 Beck ..... F01D 5/3038 416/216
(Continued)

FOREIGN PATENT DOCUMENTS

DE 2362758 A1 6/1975
EP 2562356 A1 2/2013
(Continued)

OTHER PUBLICATIONS

IPEA (PCT/IPEA/416 and 409) dated Aug. 29, 2017, for PCT/EP2016/065271.
(Continued)

*Primary Examiner* — Richard A Edgar
(74) *Attorney, Agent, or Firm* — Beusse Wolter Sanks & Maire

(57) ABSTRACT

A rotor blade arrangement for a turbomachine having a blade carrier, on whose outer circumferential surface there is formed a circumferential T-shaped slot, having a blade ring which has a plurality of blades and spacers, that are inserted in alternation into the T-shaped slot, and having support elements that are braced between the blades and spacers on one hand and a base of the T-shaped slot on the other hand such that the blades and spacers are pressed radially outward, a separate support element being assigned to each spacer and being releasably held thereon, in particular secured in a clamping manner. A method includes assembling a rotor blade arrangement.

20 Claims, 4 Drawing Sheets

(51) Int. Cl.
*F01D 5/32* (2006.01)
*F04D 29/32* (2006.01)

(52) U.S. Cl.
CPC ..... *F05D 2260/38* (2013.01); *F05D 2260/96* (2013.01)

(58) Field of Classification Search
USPC ..... 416/215, 216
See application file for complete search history.

(56) References Cited

U.S. PATENT DOCUMENTS

| | | | |
|---|---|---|---|
| 4,080,101 | A | 3/1978 | Zlotek |
| 2002/0127105 | A1 | 9/2002 | Bachofner et al. |
| 2011/0255983 | A1 | 10/2011 | Belmonte et al. |
| 2012/0063907 | A1 | 3/2012 | Cloarec |
| 2014/0234111 | A1 | 8/2014 | Sieber et al. |

FOREIGN PATENT DOCUMENTS

| | | | |
|---|---|---|---|
| FR | 2997722 | A1 | 5/2014 |
| JP | S6043102 | A | 3/1985 |

OTHER PUBLICATIONS

EP Search Report dated Jan. 27, 2016, for EP patent application No. 15176056.8.
International Search Report dated Sep. 7, 2016, for PCT/EP2016/065271.

* cited by examiner

ROTOR BLADE ARRANGEMENT HAVING ELASTIC SUPPORT ELEMENTS FOR A THERMAL TURBOMACHINE

CROSS REFERENCE TO RELATED APPLICATIONS

This application is the US National Stage of International Application No. PCT/EP2016/065271 filed Jun. 30, 2016, and claims the benefit thereof. The International Application claims the benefit of European Application No. EP15176056 filed Jul. 9, 2015. All of the applications are incorporated by reference herein in their entirety.

FIELD OF INVENTION

The invention relates to a rotor blade arrangement for a turbomachine, having a blade carrier on whose outer circumferential surface there is formed a circumferential T-shaped slot, having a blade ring which comprises a plurality of blades and spacers that are inserted in alternation into the T-shaped slot, and having support elements that are braced between the blades and spacers on the one hand and a bottom of the T-shaped slot on the other hand such that the blades and spacers are pressed radially outward. The invention also relates to a method for assembling a rotor blade arrangement according to the invention.

BACKGROUND OF INVENTION

Rotor blade arrangements of this kind are known in various configurations in the prior art and serve to convert the flow energy of a working fluid into rotational energy. A turbomachine such as a steam turbine or a gas turbine comprises a turbine casing and a turbine shaft which passes through the turbine casing and is connected to the drive shaft of a work machine, for example a generator. One or more rotor blade arrangements are held rotationally fixed on the turbine shaft, blades being held on each of these rotor blade arrangements in the form of a blade ring. During operation of the turbomachine, a circumferential force exerted by the working fluid, for example steam or hot gas, on the blades turns the turbine shaft, thus driving the work machine.

When assembling a rotor blade arrangement for a turbomachine, a blade carrier is provided with a circumferential blade ring. In that context, blades and spacers are inserted in alternation into a T-shaped slot running around the outer circumferential face of the blade carrier, and are shifted in the circumferential direction therein. To that end, the blades and spacers must be able to be shifted in the circumferential T-shaped slot. This is achieved by producing the blade roots and spacers with a clearance, in particular a radial clearance, with respect to the circumferential T-shaped slot. When assembling the blade ring on the blade carrier, the spacers and blade roots must be preloaded radially outward in order to minimize gaps that form between the spacers, the blade roots and the T-shaped slot, to ensure a secure fit in particular of the blades even at low rotational speeds of the turbine shaft and, where necessary, to be able to subsequently work the tips of the blades with a high degree of precision even in the mounted state.

For that reason, EP 2 562 356 A1 for example proposes inserting into the T-shaped slot support elements that are braced between the bottom of the T-shaped slot on the one hand and the undersides of the blades and the spacers on the other hand and press the blades and the spacers radially outward against shoulder faces of the T-shaped slot, and thus secure the blades and spacers in the radial direction. However, when assembling a rotor blade arrangement it must be ensured that the support elements remain at their intended position at the bottom of the T-shaped slot. This can be done for example by means of additional slots within the T-shaped slot, in which the support elements are held. Alternatively, as proposed in EP 2 562 356 A1, the support elements can also be dimensioned and configured such that they reciprocally hold themselves in position, at least in the circumferential direction. In order to compensate for any manufacturing tolerances, the support elements are produced with a certain excess length in the circumferential direction, so that the last support element that is to be inserted into the T-shaped slot must be appropriately shortened in order to fit in the remaining gap, which incurs an additional cost. A fundamental difficulty in handling such support elements lies in the fact that access to the intermediate space between the undersides of the spacers and blades on the one hand and the bottom of the T-shaped slot on the other, for the purpose of positioning the support elements therein, is extremely difficult.

SUMMARY OF INVENTION

Starting from this prior art, it is an object of the present invention to provide a rotor blade arrangement of the type stated at the outset involving alternative construction which is simple to assemble.

In order to achieve the object of the invention, the present invention provides a rotor blade arrangement of the type mentioned in the introduction, in which a separate support element is assigned to each spacer and is releasably held thereon, in particular secured in a clamping manner.

The invention is based on the idea of releasably fixing the support elements to the associated spacers by clamping. This securing process can be carried out outside the T-shaped slot. Only then is the spacer, provided with the support element, inserted into the T-shaped slot and shifted in the circumferential direction to its intended position, so that the support element together with the associated spacer automatically reaches the desired position. In this position, the support element is clamped on the one hand between the underside of the spacer and the bottom of the T-shaped slot and on the other hand between the underside of the blade and the bottom of the T-shaped slot. Assembly is simple as a result.

In one embodiment of the present invention, the support elements are designed as elastic spring plates and arranged such that the associated spacers in the T-shaped slot are preloaded radially outward. For shifting in the circumferential direction of the T-shaped slot, the spacers can be pressed inward counter to the outward-oriented elastic return force of the spring plates in order to establish the radial clearance that is required for shifting.

Advantageously, at least one radially outward projecting projection is formed on each of the support elements, which projection comes into engagement with the respective associated spacer in order to releasably secure the support elements on the associated spacers.

For example, cutouts corresponding to the projections can be formed in the spacers, into which cutouts the projections of the support elements engage, in particular in a clamping manner. Clamping engagement in a cutout represents a manner for securing that is both secure and easily releasable.

In a development of the present invention, the cutouts are arranged axially centrally on the spacers, wherein they have in particular an axial breadth that corresponds to at least 30% and in particular at least 50% of the axial breadth of the spacers. In that context, the projections of the support elements have, in particular, an axial breadth that corresponds to the axial breadth of the cutouts. In particular, the breadth of the projections can be chosen such that the support elements are positioned axially in the cutouts by means of the projections. This ensures that the support elements are oriented axially centrally with respect to the spacers and thus both the clamping forces exerted by the projections on the spacers and also the radially outward oriented preload forces that the support elements exert on the spacers are introduced centrally into the spacers.

Advantageously, on each of the support elements there are formed two projections that are spaced apart in the circumferential direction of the T-shaped slot. Two projections permit a particularly stable connection between a support element and the associated spacer.

According to one development of this embodiment, the two projections are in each case arranged on the support elements such that the associated spacers are clamped between the projections. This manner of engagement is particularly simple to manipulate during assembly of the rotor blade arrangement. Specifically, the intermediate pieces thus also serve as an assembly tool for pushing one of the ends of the support elements into the space between the blade root underside and the bottom of the T-shaped slot.

Advantageously, the relevant projections of the support elements are configured such that, when bearing laterally against the respective immediately adjacent blade, they exert a force thereon acting in the circumferential direction, wherein the relevant projections are in each case essentially U-shaped and have two elastic limbs which are connected to one another and of which one limb bears against the spacer and the other limb bears, preloaded, against the relevant adjacent blade. This makes it possible to secure all of the intermediate pieces and blades in an essentially clearance-free manner.

According to one embodiment of the invention, the two corresponding cutouts are formed on end faces of the spacer that are opposite in the circumferential direction of the T-shaped slot. In other words, the two cutouts are open in the circumferential direction of the T-shaped slot. Cutouts of this kind, of open design, are easy to produce. Furthermore, arranging the cutouts in this manner maximizes the distance between them, which means that the support element is unlikely to twist relative to the spacer. Moreover, cutouts that are open in the circumferential direction of the T-shaped slot can facilitate manipulation of the support elements during connection with the respective associated spacers.

In another configuration of an embodiment, the projections of the support elements can be received in the corresponding cutouts of the associated spacers such that the end faces of the spacers come to bear against adjacent blades. In other words, the cutouts are formed such that the projections are fully accommodated in the corresponding cutouts so that they do not stand proud of the end faces in the circumferential direction of the T-shaped slot. Thus, the blades and spacers can be assembled to form a gap-free blade ring.

In one variant of the invention, an in particular wave-shaped spring region is formed in each case between the projections such that the spring region, adjacent to the projections, comes to bear against the bottom of the T-shaped slot, and in a central region comes to bear against the associated spacer. A wave-shaped spring region can apply the outward oriented elastic force necessary for radially preloading the spacers, and is simple to produce and manipulate. Alternatively and/or in addition to the wave-shaped spring region, it would also be possible for the projections to be configured such that they bear, preloaded, against radially inward oriented faces of the cutouts in order to radially brace the intermediate pieces.

Advantageously, the support elements are arranged spaced apart from one another in the circumferential direction of the T-shaped slot. The consequence of this is that manufacturing tolerances that arise during production of the support elements require no subsequent manual machining during assembly. Also advantageously, each one of the blades in question is pressed radially outward by two adjacent intermediate pieces.

In one variant according to the invention, end regions, opposite one another in the circumferential direction of the T-shaped slot, of the support elements project from the associated spacers such that they engage under adjacent blades. End regions of this kind can for example be formed as tongues that extend into the intermediate space between an adjacent blade and the bottom of the T-shaped slot.

In that context, the projecting end regions are designed such that they preload the adjacent blades radially outward, and in so doing in each case come to bear against the adjacent blade and the bottom of the T-shaped slot. Thus, the adjacent blade is pressed outward and is fixed in the radial direction.

According to one development of this embodiment, at least one bead is formed on each end region, which bead comes to bear against the bottom of the T-shaped slot and is in particular positioned in an axially central region of the end region. In that context, the beads can have an axial breadth that corresponds to at least 30% and in particular at least 50% of the axial breadth of the end region. Beads can be introduced into the end regions of the support elements simply and cost effectively, for example by stamping. The central arrangement of the beads ensures that the radially outward pressure on the blades engaged from below is even with respect to the axial direction. In that context, broader beads are more elastic, which makes manipulation easier.

Furthermore, the present invention provides a method for assembling a rotor blade arrangement according to the invention, using spacers and support elements according to the invention and comprising the following steps:—a blade is inserted into the T-shaped slot and is shifted in the circumferential direction of the T-shaped slot to its intended position; —a support element is arranged on a spacer such that the support element is releasably held on the spacer, in particular secured in a clamping manner; —the spacer, with the support element arranged thereon, is inserted into the T-shaped slot and is shifted in the circumferential direction of the T-shaped slot such that an end face of the spacer comes to bear against the blade inserted into the T-shaped slot and an end region of the support element engages under the inserted blade; —a further blade is inserted into the T-shaped slot and is shifted in the circumferential direction of the T-shaped slot such that the further blade comes to bear against the opposite end face of the inserted spacer and the opposite end region of the support element engages under the further blade.

In this method, the arrangement of the support elements relative to the spacers takes place outside the T-shaped slot, which is associated with simple handling, in particular without special tools. Independent positioning of the support elements, which is difficult to carry out owing to the poor accessibility of the intermediate space between the bottom of the T-shaped slot and the undersides of the blades and spacers, is no longer necessary. Furthermore, subsequent manual machining of the support elements during assembly of the rotor blade arrangement is not necessary.

The rotor blade arrangement according to the invention can find application in particular in axial-flow thermal turbomachines. The term thermal turbomachines can be understood as referring both to compressors and to turbines. In that context, the turbine can be designed as a steam turbine or alternatively as a turbine unit of a gas turbine.

BRIEF DESCRIPTION OF THE DRAWINGS

Further features and advantages of the present invention will become clear from the following description of an embodiment of the rotor blade arrangement according to the invention, with reference to the appended drawing, in which.

DETAILED DESCRIPTION OF INVENTION

Figure 1:
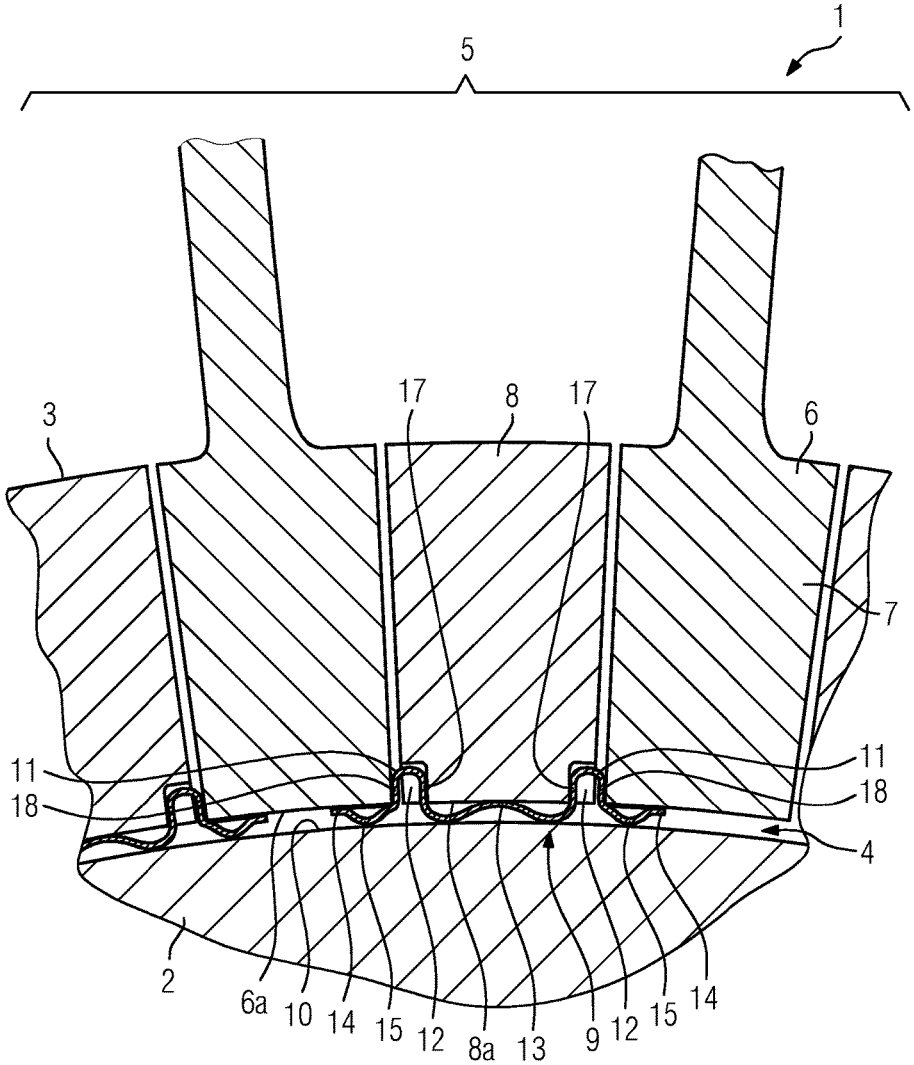
FIG. 1 is a cross-sectional view of a portion of a rotor blade arrangement according to one embodiment of the present invention.
Figure 2:
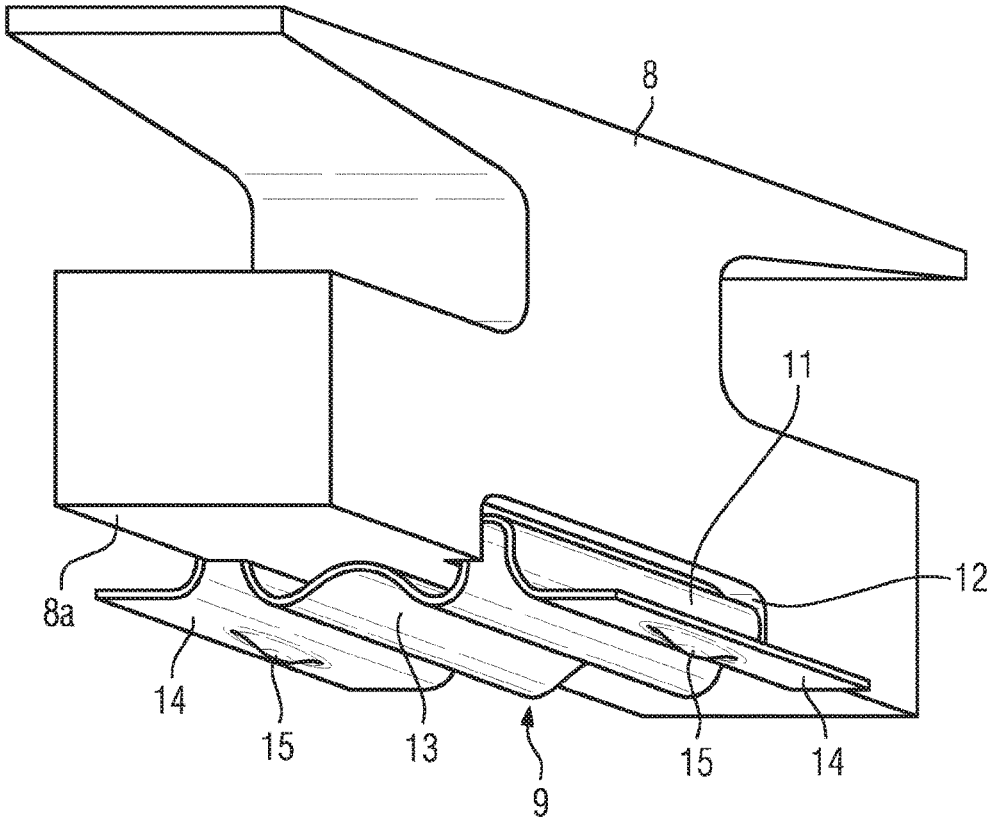
FIG. 2 is a perspective view from below of a support element, of the rotor blade arrangement shown in FIG. 1, that is held on a spacer.
Figure 3:
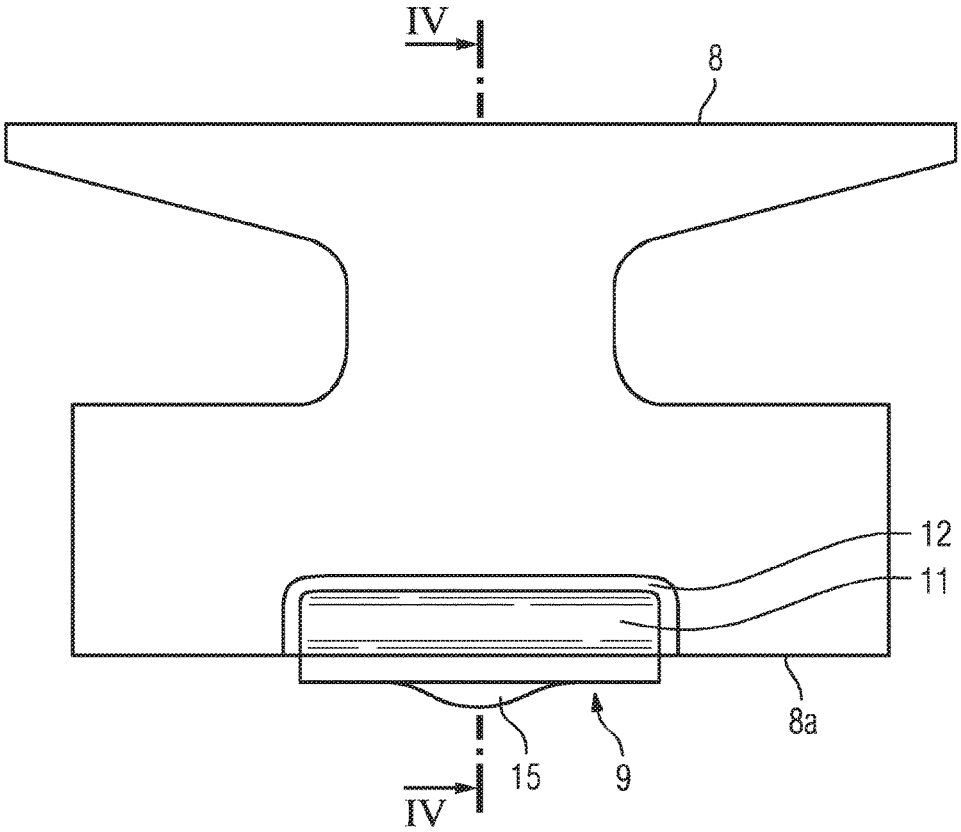
FIG. 3 is a side view of the spacer shown in FIG. 2.
Figure 4:
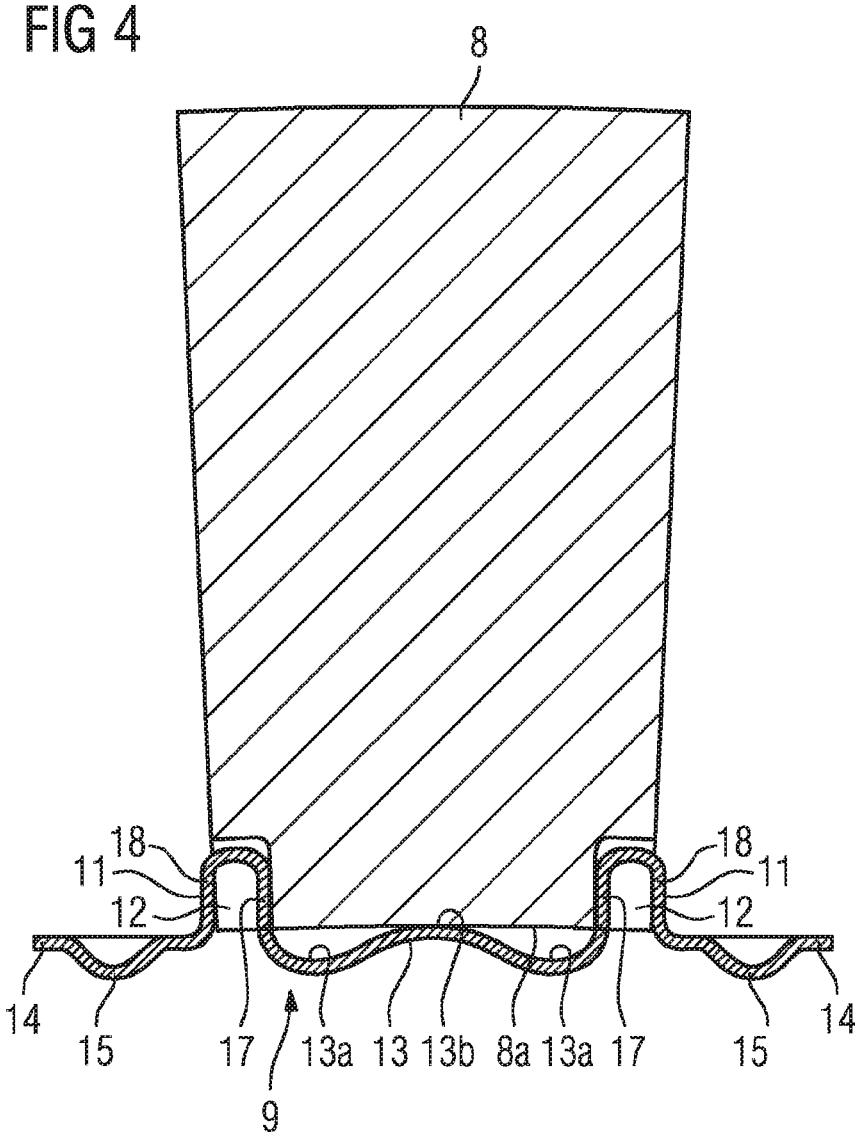
FIG. 4 is a cross-sectional view, along the line IV-IV, of the spacer shown in FIG. 3.

FIGS. 1 to 4 show a rotor blade arrangement 1 for a turbomachine according to one embodiment of the present invention. The rotor blade arrangement 1 comprises a blade carrier 2 on whose outer circumferential surface 3 there is formed a circumferential T-shaped slot 4, and a blade ring 5. The blade ring 5 has a plurality of blades 6 and spacers 8, wherein blade roots 7 of the blades 6 are inserted, in alternation with the spacers 8, into the T-shaped slot 4.

Furthermore, the rotor blade arrangement 1 comprises support elements 9 that are braced between the respective undersides 6*a* of the blades 6 and the respective undersides 8*a* of the spacers 8 on the one hand and a bottom 10 of the T-shaped slot 4 on the other hand such that the blades 6 and the spacers 8 are pressed radially outward against shoulder faces of the T-shaped slot. The support elements 9 are designed as elastic spring plates and are arranged spaced apart from one another in the circumferential direction of the T-shaped slot 4. In that context, a separate support element 9, which is releasably fixed, is assigned to each spacer 8.

To that end, two radially outward projecting projections 11 are formed on each of the support elements 9 in the present case. The projections 11 can be designed as portions of the elastic spring plate that are U-shaped in cross section and comprise two limbs 17, 18 that are connected to one another. The projections 11 engage with the respective associated spacer 8 in order to securely clamp the support elements 9 against the associated spacers 8.

Specifically, the spacers 8 have cutouts which correspond to the projections 11 of the associated support elements 9 and which are designed as open depressions in the circumferential-side end faces of the spacers 8. In that context, the depth of the cutouts in the circumferential direction is such that the projections 11 are fully accommodated in the cutouts 12, and the spacer 8 is securely clamped between the projections 11. In that context, the cutouts 12 are arranged axially centrally on the spacers 8, and have an axial breadth that corresponds to approximately 50% of the axial breadth of the spacers 8. Furthermore, the projections 11 of the support elements 9 have an axial breadth that corresponds to the axial breadth of the cutouts 12, so as to ensure that the support elements 9 are positioned and engage approximately axially centrally on the spacers 8.

Advantageously, the two projections 11 of each support element 9, as seen in the circumferential direction, can be configured such that they project slightly from the cutouts 12. Consequently, the inner end of the intermediate piece 8 in question is then resiliently clamped between the two first limbs 17 of the two projections 11, wherein the two other limbs 18 extend outward via those side faces of the intermediate pieces that are oriented toward the adjacent blades 6. Owing to the arcuate connection region between the two limbs 17, 18 of each projection 11, the limbs 17, 18 thereof are able to move elastically with respect to one another. In the assembled state, the limbs 18 bear, preloaded, against the sidewalls of the blades 6 so that the circumferential bracing produced thereby ensures a clearance-free fit of the intermediate pieces 8 and the blades 6.

Alternatively, a support element 9 can also be secured to a spacer 8 by means of a single projection 11 and a single corresponding cutout 12.

A wave-shaped spring region 13 is formed between the two projections 11 and has in each case, adjacent to the two projections 11, wave troughs 13*a* that come to bear against the bottom 10 of the T-shaped slot 4 and, between the wave troughs 13*a*, a wave peak 13*b* that comes to bear against the associated spacer 8.

The support elements 9 also have, opposite one another in the circumferential direction of the T-shaped slot 4, end regions 14 which in the present case are tongue-shaped and which project from the associated spacers 8 in the circumferential direction of the T-shaped slot 4 such that they engage under adjacent blades 6. Each projecting end region is designed such that it preloads the adjacent blade 6 radially outward and presses it against shoulder faces of the T-shaped slot 4, wherein it comes to bear against the adjacent blade 6 and the bottom 10 of the T-shaped slot 4. In that context, a bead 15, which is formed at each projecting end region 14 and projects radially inward from the end region 14, comes to bear against the bottom 10 of the T-shaped slot 4 while the free end of the projecting end region bears against the adjacent blade 6. The bead 15 is positioned in an axially central region of the end region 14 and has an axial breadth that corresponds to approximately 50% of the axial breadth of the end region 14.

In order to assemble a rotor blade arrangement according to the invention, a blade 6 is first inserted into the T-shaped slot 4 and is shifted in the circumferential direction of the T-shaped slot 4 to its intended position. Then a support element 9 is clamped on a spacer 8. In that regard, the support element 9 is fitted onto the spacer 8 from below so that the two projections 11 of the support element 9 come into clamping engagement with the corresponding cutouts 12 of the spacer 8. Then, the spacer 8, with the support element 9 arranged thereon, is inserted into the T-shaped slot 4 and is shifted in the circumferential direction of the T-shaped slot 4 such that an end face of the spacer 8 comes to bear against the blade 6 inserted into the T-shaped slot 4 and an end region 14 of the support element 9 engages under the inserted blade 6. In the case of the above-described support element 9, the spacer 8 inserted into the T-shaped slot 4 is preloaded radially outward by the elastic spring force of the spring region 13. Therefore, for shifting, a radially inward oriented force is exerted on the spacer 8 counter to its outward-oriented elastic return force. Then, a further blade 6 is inserted into the T-shaped slot 4 and is shifted in the circumferential direction of the T-shaped slot 4 such that the further blade 6 comes to bear against the opposite end face of the spacer 8 and the opposite end region 14 of the support element 9 engages under the further blade 6. Both adjacent blades 6 are pressed, by the beads 15 provided in each case on the under-engaging end region 14, radially outward in the T-shaped slot against shoulder faces of the T-shaped slot 4, and are radially immobilized. These method steps are repeated until the blade ring 5—apart from a final gap—is closed. Finally, a special closing assembly (not shown) is inserted into the remaining gap in order to close the blade ring 5.

An essential advantage of the rotor blade arrangement 1 according to the invention is that the support elements 9 are easily secured on the spacers 8 outside the T-shaped slot 4, and subsequently are handled only together with the associated spacers 8. Thus, assembling a rotor blade arrangement 1 according to the invention requires no special method steps and/or tools for correctly placing the support elements 9 in the T-shaped slot 4, which implies simple assembly of the blade ring 5.

Although the invention has been described and illustrated in detail by way of the preferred exemplary embodiment, the invention is not restricted by the disclosed examples and other variations can be derived herefrom by a person skilled in the art without departing from the scope of protection of the invention.

The invention claimed is:

1. A rotor blade arrangement for a turbomachine, comprising:

a blade carrier on whose outer circumferential surface there is formed a circumferential T-shaped slot, a blade ring which comprises a plurality of blades and spacers that are inserted in alternation into the T-shaped slot along the circumference of the T-shaped slot, and having support elements that are braced between the blades and spacers on the one hand and a bottom of the T-shaped slot on the other hand such that the blades and spacers are pressed radially outward, and a separate support element which is assigned to each spacer and is releasably held thereon.

2. The rotor blade arrangement as claimed in claim 1, wherein the support elements are designed as elastic spring plates and arranged such that the associated spacers in the T-shaped slot are preloaded radially outward.

3. The rotor blade arrangement as claimed in claim 1, wherein at least one radially outward projecting projection is formed on each of the support elements, which projection comes into engagement with the respective associated spacer in order to secure the support elements on the associated spacers.

4. The rotor blade arrangement as claimed in claim 3, wherein cutouts corresponding to the projections are formed in the spacers, into which cutouts the projections of the support elements engage in a clamping manner.

5. The rotor blade arrangement as claimed in claim 4, wherein the cutouts are arranged axially centrally on the spacers, wherein they have an axial breadth that corresponds to at least 30% of the axial breadth of the spacers.

6. The rotor blade arrangement as claimed in claim 5, wherein the cutouts are arranged axially centrally on the spacers and have an axial breadth that corresponds to at least 50% of the axial breadth of the spacers.

7. The rotor blade arrangement as claimed in claim 5, wherein the axial breadth of the projections of the support elements corresponds at least substantially to the axial breadth of the cutouts.

8. The rotor blade arrangement as claimed in claim 4, wherein on each of the support elements there are formed two projections that are spaced apart in the circumferential direction of the T-shaped slot.

9. The rotor blade arrangement as claimed in claim 8, wherein the two projections are in each case arranged on the support elements such that the associated spacers are clamped between the projections.

10. The rotor blade arrangement as claimed in claim 8, wherein the relevant projections of the support elements are configured such that, when bearing against the respective immediately adjacent blade, they exert a force acting in the circumferential direction.

11. The rotor blade arrangement as claimed in claim 10, wherein the relevant projections are in each case essentially U-shaped and have two elastic limbs which are connected to one another and of which one limb bears against the spacer and the other limb bears against the relevant adjacent blade.

12. The rotor blade arrangement as claimed in claim 8, wherein the two corresponding cutouts are formed on end faces of the spacer that are opposite in the circumferential direction of the T-shaped slot.

13. The rotor blade arrangement as claimed in claim 8, wherein the projections of the support elements are received in the corresponding cutouts of the associated spacers such that the end faces of the spacers come to bear against adjacent blades.

14. The rotor blade arrangement as claimed in claim 8, wherein a wave-shaped spring region is formed in each case between the projections such that the spring region, adjacent to the projections, comes to bear against the bottom of the T-shaped slot, and a central region comes to bear against the associated spacer.

15. The rotor blade arrangement as claimed in claim 1, wherein the support elements are arranged spaced apart from one another in the circumferential direction of the T-shaped slot, and/or each one of the blades in question is pressed radially outward by two adjacent intermediate pieces.

16. The rotor blade arrangement as claimed in claim 1, wherein end regions, opposite one another in the circumferential direction of the T-shaped slot, of the support elements project from the associated spacers such that they engage under adjacent blades.

17. The rotor blade arrangement as claimed in claim 16, wherein each projecting end region is designed such that it preloads the adjacent blade radially outward, and in so doing comes to bear against the adjacent blade and the bottom of the T-shaped slot.

18. The rotor blade arrangement as claimed in claim 17, wherein at least one bead is formed on each end region, which bead comes to bear against the bottom of the T-shaped slot and is positioned in an axially central region of the end region.

19. The rotor blade arrangement as claimed in claim 1, wherein the separate support element is releasably held thereon in a clamping manner.

20. A method for assembling a rotor blade arrangement as claimed in claim 16, comprising the following steps:

inserting a blade into the T-shaped slot and shifting the blade in the circumferential direction of the T-shaped slot to its intended position;

arranging a support element on a spacer such that the support element is releasably held on the spacer, in a clamping manner;

inserting the spacer, with the support element arranged thereon, into the T-shaped slot and shifting the spacer in the circumferential direction of the T-shaped slot such that an end face of the spacer comes to bear against the blade inserted into the T-shaped slot and an end region of the support element engages under the inserted blade;

inserting a further blade into the T-shaped slot and shifting the further blade in the circumferential direction of the T-shaped slot such that the further blade comes to bear against the opposite end face of the inserted spacer and the opposite end region of the support element engages under the further blade.

* * * * *